US005566825A

United States Patent [19]

Price

[11] Patent Number: 5,566,825

[45] Date of Patent: Oct. 22, 1996

[54] GOLF BAG WITH A POCKET HAVING MULTIPLE OPENINGS

[75] Inventor: David Price, Hendersonville, Tenn.

[73] Assignee: Wilson Sporting Goods Co., Chicago, Ill.

[21] Appl. No.: 378,406

[22] Filed: Jan. 26, 1995

[51] Int. Cl.[6] ..... A63B 55/00

[52] U.S. Cl. ..... 206/315.5; 206/315.3

[58] Field of Search ..... 206/315.3–315.7

[56] References Cited

U.S. PATENT DOCUMENTS

| | | | |
|---|---|---|---|
| 1,570,500 | 1/1926 | Kennedy | 206/315.6 |
| 1,709,582 | 4/1929 | Kahle | 206/315.5 |
| 1,845,088 | 2/1932 | Hunerhoff | 206/315.5 |
| 2,094,186 | 9/1937 | Patrick | 150/1.5 |
| 2,114,870 | 4/1938 | Calkins | 206/315.6 |
| 2,165,665 | 7/1939 | Thompson | 150/1.5 |
| 2,587,029 | 2/1952 | Burton, Jr. et al. | 150/1.5 |
| 2,698,040 | 12/1954 | Wilkens | 206/315.5 |
| 2,704,563 | 3/1955 | Henrich | 150/1.5 |
| 2,711,201 | 6/1955 | Hotze | 206/315.5 |
| 2,861,613 | 11/1958 | Kish, Jr. | 150/1.5 |
| 2,861,614 | 11/1958 | Kish, Jr. | 206/315.5 |
| 2,985,212 | 5/1961 | Dozier | 150/52 |
| 3,259,160 | 7/1966 | Penna | 206/315.5 |
| 3,985,171 | 10/1976 | Summers et al. | 150/52 |
| 4,181,167 | 1/1980 | Ret | 150/1.5 |
| 4,249,586 | 2/1981 | Setani | 206/315.5 |
| 4,263,950 | 4/1981 | Brown | 206/315.6 |
| 4,350,194 | 9/1982 | Brown | 150/1.5 |
| 4,699,164 | 10/1987 | Pilney et al. | 135/16 |
| 4,779,725 | 10/1988 | Gerber | 206/315.3 |
| 5,024,259 | 6/1991 | Treadway | 150/159 |
| 5,029,703 | 7/1991 | Dulyea, Sr. | 206/315.3 |
| 5,038,984 | 8/1991 | Izzo | 224/209 |
| 5,042,703 | 8/1991 | Izzo | 224/209 |
| 5,042,704 | 8/1991 | Izzo | 224/209 |
| 5,094,283 | 3/1992 | Lawrence | 150/160 |
| 5,168,992 | 12/1992 | Bowdy | 206/315.6 |
| 5,176,253 | 1/1993 | Perrin et al. | 206/315.3 X |
| 5,215,194 | 6/1993 | Blanford et al. | 206/315.3 |
| 5,222,596 | 6/1993 | Jordan | 206/315.6 |
| 5,222,598 | 6/1993 | Yamazoe | 206/315.5 |
| 5,267,660 | 12/1993 | Kwon | 211/70.2 |
| 5,280,798 | 1/1994 | Helm | 135/16 |
| 5,402,883 | 4/1995 | Shin | 206/315.4 X |

FOREIGN PATENT DOCUMENTS

| | | | |
|---|---|---|---|
| 274182 | 11/1966 | Australia | 206/315.4 |
| 376766 | 7/1932 | United Kingdom . | |
| 414178 | 8/1934 | United Kingdom | 206/315.3 |
| 432468 | 7/1935 | United Kingdom . | |
| 471071 | 8/1937 | United Kingdom | 206/315.3 |

*Primary Examiner*—Sue A. Weaver

*Attorney, Agent, or Firm*—Tilton, Fallon, Lungmus & Chestnut

[57] ABSTRACT

A golf bag includes a generally tubular bag portion having an elongate body, a bottom and an open top. The bag portion defines a pocket with a cavity, a first access opening disposed at one side of the golf bag and a second access opening disposed at a second side of the golf bag. Each access opening communicates with the inside of the pocket. First and second closing devices close and open the first and second access openings, respectively.

6 Claims, 1 Drawing Sheet

GOLF BAG WITH A POCKET HAVING MULTIPLE OPENINGS

BACKGROUND OF THE INVENTION

1. Field of the Invention

This invention relates to a golf bag with a pocket having multiple access openings, and more particularly to a golf bag with a pocket having openings on different sides of the bag for easy access to the pocket.

2. Description of the Prior Art

A golf bag includes an elongate body closed at a bottom end by a base and open at a top end. The body usually includes one or more pockets for storing items such as balls, tees, rain gear, and wind breakers. Each pocket has an opening through which one may place items in the pocket or retrieve them from the pocket. A closing device normally closes the opening.

It is desirable to have easy access to the inside of a pocket. In many instances, one may easily manipulate a golf bag to gain access to one of its pockets. However, when the bag lies secured on a golf car, cart, or other support, its position may render the access opening of a pocket inaccessible.

The golf bag of the present invention avoids this disadvantage. It includes a pocket with at least two openings on different sides of the golf bag. It allows easy access to items disposed in storage compartments while minimizing the cost of manufacture.

SUMMARY OF THE INVENTION

In accordance with one embodiment of this invention, a golf bag includes a generally tubular bag portion having an elongate body, a bottom and an open top. The bag portion defines a pocket with a cavity, a first access opening disposed at one side of the golf bag and a second access opening disposed at a second side of the golf bag. Each access opening communicates with the same space inside of the pocket. First and second closing devices close and open the first and second access openings, respectively.

BRIEF DESCRIPTION OF THE DRAWINGS

For a more complete understanding of this invention one should now refer to the embodiment illustrated in greater detail in the accompanying drawings and described below by way of an example of the invention. In the drawings.

While the following disclosure describes the invention in connection with one embodiment, one should understand that the invention is not limited to this embodiment. Furthermore, one should understand that the drawings are not to scale and that graphic symbols, diagrammatic representations, and fragmentary views, in part, may illustrate the embodiment. In certain instances, the disclosure may not include details which are not necessary for an understanding of the present invention, such as conventional details of fabrication and assembly.

DETAILED DESCRIPTION OF THE DRAWINGS AND AN EMBODIMENT

Figure 1:
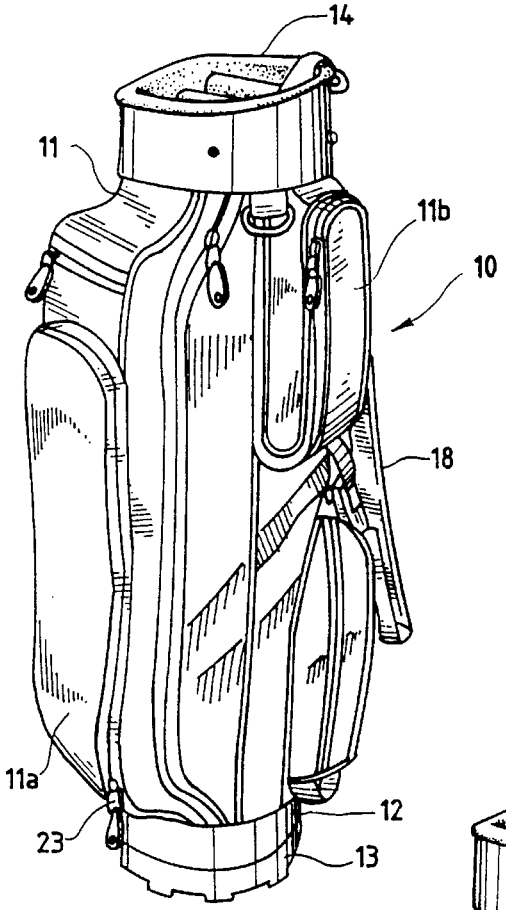
FIG. 1 is a perspective view of the golf bag of the present invention.

Turning now to the drawings, FIG. 1 shows the golf bag of the present invention generally at 10. The bag 10 includes an elongate, tubular body 11 closed at a bottom end 12 by a base member 13 and open at a top end 14. The body 11 may be fabricated from any suitable material, including any suitable, natural or synthetic, fabric material supported by bracing members such as spaced vertical rods and horizontal rings made of metal or any other material of sufficient strength and rigidity. The base member 13 may also be any suitable material (e.g., plastic).

The body 11 includes a plurality of pockets 11*a* and 11*b* for storing items such as balls, tees, and garments. It defines a central opening 15 divided into compartments by a pair of dividers 16 and 17. These compartments receive a number of golf clubs. A player typically places the clubs into the bag by inserting the handle portion of the club into the body 11. The player may then load the bag onto his or her shoulder using a strap 18 and carry it to a desired location.

Figure 2:
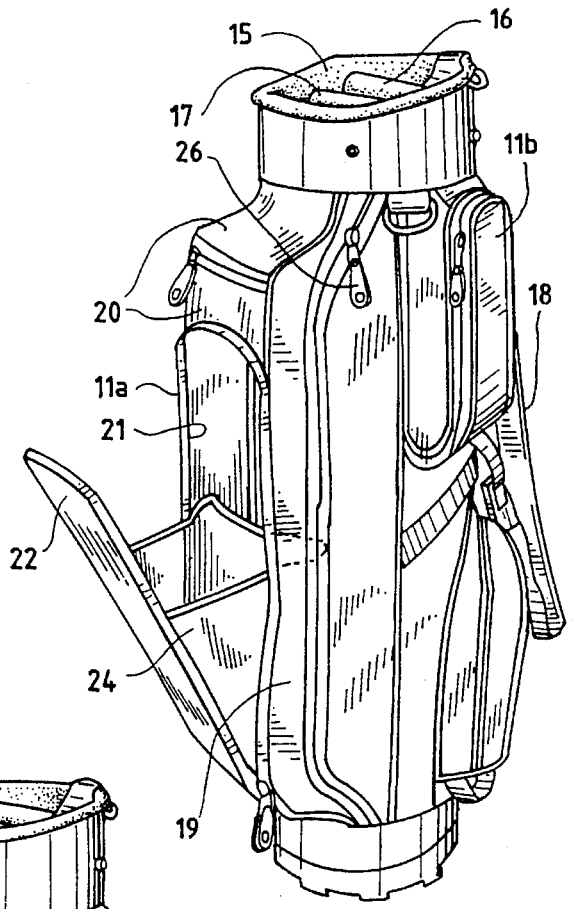
FIG. 2 is a perspective view, showing an elongate pocket in the body of the golf bag with an open, elongate front opening and a flap.

The pocket 11*a* is an elongate enclosure that extends longitudinally of the body 11. It includes a sidewall panel 19, an opposite sidewall panel (not shown), a front wall panel 20 and a back wall panel (not shown). The front wall panel 20 defines an elongate opening 21 (See FIG. 2) which allows access into the pocket or cavity defined by the wall panels and a flap 22 that normally covers the opening 21. A zipper closure 23 (or any other suitable closure or fastening means) releasably secures the flap 22 to the remaining portion of the front wall panel 20. A webbing 24 secured to the inside walls of the pocket 11a and to the flap 22 limits the movement of the flap 22 outwardly of the body 11 and serves as a catch for objects placed in the pocket 11*a*.

Figure 3:
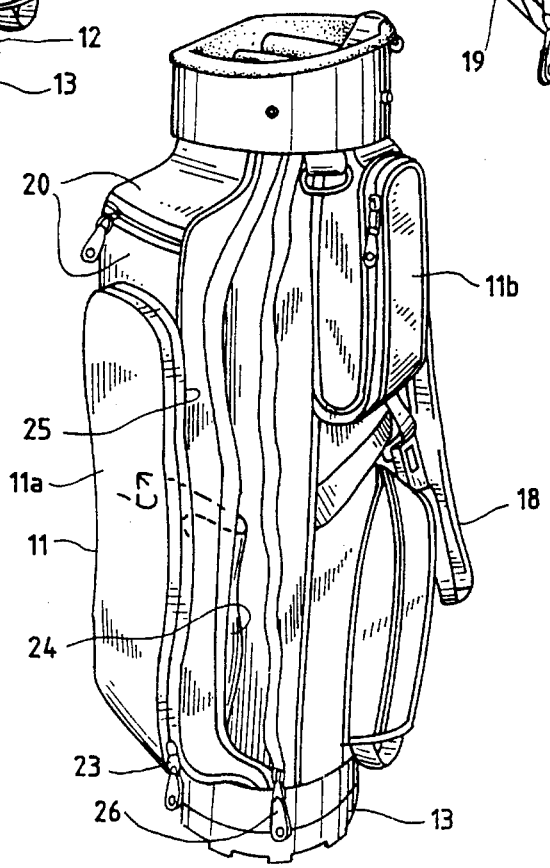
FIG. 3 is the perspective view of FIG. 1, showing the elongate pocket with an opened side opening.

A slit 25 (See FIG. 3) formed into the sidewall panel 19 provides a second access opening for the pocket 11. This second access opening extends generally longitudinally of the body 11 from one end to the other. Thus, when the bag lies in a position that renders the first access opening 21 inaccessible, one may gain access to the inside of the pocket 11a through the slit 25. A zipper closure 26 (or any other suitable closure or fastening means) releasably secures the edge portions of the slit and closes it.

The embodiment described above includes a pocket with two access openings and a flap for one of the openings. Alternatively, the pocket may include more than two openings; and the openings provided for the pocket may or may not include a flap cover.

While the above description and the drawings disclose and illustrate one embodiment, one should understand, of course, that the invention is not limited to this embodiment. Those skilled in the art to which the invention pertains may make modifications and other embodiments employing the principles of this invention, particularly upon considering the foregoing teachings. Therefore, by the appended claims, the applicant intends to cover any modifications and other embodiments as incorporate those features which constitute the essential features of this invention.

What is claimed is:

1. A golf bag comprising: a generally tubular bag portion having an elongate, generally tubular body with a bottom and an open top, said bag portion defining a pocket with a cavity, a first elongate access opening disposed at one side of the golf bag generally longitudinally of the tubular body and a second elongate access opening disposed at a second side of the golf bag generally longitudinally of the tubular body, each access opening communicating with the inside of the pocket; first closure means for closing and opening the first access opening; and second closure means for closing and opening the second access opening; the first and second sides lying generally perpendicularly to each other; the first and second elongate openings extending across a substantial portion of the length of the tubular body.

2. The golf bag of claim 1, wherein the tubular bag portion includes a flap for covering the first access opening, the first closure means securing the flap over the first access opening.

3. The golf bag of claim 2, wherein the flap includes a flat outer portion and an inner pouch portion which provides an open compartment inside the pocket.

4. The golf bag of claim 1, wherein the pocket is elongate, the first access opening has a predetermined length and width, and the second access opening is an elongate slit that extends generally parallel to the first access opening.

5. The golf bag of claim 4, wherein the first closure means extends along a path having a generally U-shaped configuration.

6. The golf bag of claim 1, wherein the first and second closure means are zipper-type closures.

* * * * *